US005725980A

United States Patent [19]

Springett

[11] Patent Number: 5,725,980

[45] Date of Patent: Mar. 10, 1998

[54] MULTI-WAVELENGTH LASER WHICH AVOIDS EXCESSIVE LIGHT ABSORPTION BY CYAN PIGMENT IN IMAGE-ON-IMAGE ELECTROPHOTOGRAPHY

[75] Inventor: Brian E. Springett, Rochester, N.Y.

[73] Assignee: Xerox Corporation, Stamford, Conn.

[21] Appl. No.: 784,646

[22] Filed: Jan. 21, 1997

[51] Int. Cl.[6] ..... G03G 13/01

[52] U.S. Cl. ..... 430/45; 430/945

[58] Field of Search ..... 430/54, 45, 945

[56] References Cited

U.S. PATENT DOCUMENTS 4,587,189 5/1986 Hon et al. ..... 430/59

5,048,040 9/1991 Paoli ..... 372/50

5,083,163 1/1992 Brown et al. ..... 430/54

5,552,253 9/1996 Kovacs et al. ..... 430/54

*Primary Examiner*—John Goodrow

[57] ABSTRACT

Full process color imaging using black, magenta, cyan and yellow toners. A photoreceptor is utilized which is responsive to two beams of a dual wavelength laser diode exposure device or of Light Emitting Diode (LED) exposure devices operating at two different wavelengths. One of the light beams emitted by the exposure device is utilized to imagewise discharge the photoreceptor through the magenta and yellow toners while the other beam is used to imagewise expose the photoreceptor through the cyan toner.

5 Claims, 3 Drawing Sheets

MULTI-WAVELENGTH LASER WHICH AVOIDS EXCESSIVE LIGHT ABSORPTION BY CYAN PIGMENT IN IMAGE-ON-IMAGE ELECTROPHOTOGRAPHY

BACKGROUND OF THE INVENTION

This invention relates to the creation of full process color images using Image-On-image (IOI) electrophotography and more particularly to a full process imaging system which provides greater image processing latitude in conjunction with the use of cyan toner.

Existing processes for creating color documents using I-O-I employ 780–820 nm Laser Diodes (LD) and IR (780–820 nm) sensitive photoreceptors. The Panasonic FPC-I printer uses a layered Se:Te alloy photoreceptor, while the Konica 8028 and HP Color Laser Jet 5 use an Organic Photoreceptor (OPC) with a phthalocyanine ($x$-$H_2Pc$) pigment. Both use a multi-pass approach whereby the toner images are created on the photoreceptor surface pixel by pixel. The images are created on each pass by re-charging already developed toner images followed by exposure through whatever toner is on the photoreceptor or no exposure as required (or, possibly, avoiding exposing through a prior toner image). The exposure and recharge steps are repeated until all four colors (YMCK) have been laid down. A single transfer step is then employed to move the image to a final substrate such as paper, etc. This process is clearly cost and size advantaged. There are several drawbacks that are independent of the photoreceptor (except for its thickness), and one that is photoreceptor dependent. This process is disadvantaged in terms of a redcued color gamut unless toner is developed on top of toner (Image-On-Image [IOI]); and in terms of speed since the color images are produced four (4) times slower than the black (or single color) only images, and since the time dependent processes become speed limitations due to the small size of the photoreceptor and other components.

The major photoreceptor dependent drawback is that an IR sensitive photoreceptor must be used to avoid the strong absorption by cyan toner. However, non-IR photoreceptors such as BZP AMAT (see U.S. Pat. No. 4,587,189 granted Hor et al on May 6, 1986) and amorphous Silicon (a-Si) are preferred. The a-Si photoreceptor is preferred because of its very long life and potential compatibility with Liquid Ink Development (LID) systems; it can only be used in drum form implying a multi-pass process. The a-Si photoreceptor trades off long life against high unit cost; a-Si also is not very responsive in the 780–820 nm spectral region. The reason for advocating BZP AMAT is its superb stability which is what is required to deliver superior color print quality for production systems, as well as for office color machines. BZP AMAT is also preferred because it does not exhibit ghosting. Additional reasons for advocating BZP AMAT are that it is an organic photoreceptor and can be produced in both drum and belt forms, and it has reasonable life at low unit cost. But BZP AMAT does not respond well beyond 720 nm. In order to achieve excellent color Print Quality (PQ) it is necessary to adjust the LD power for each pixel due to the varying absorption resulting from the different amounts of colored toners that are used at each pixel. Moderate swings in power are necessary at 780 nm but when cyan toner is encountered large power shifts are required at shorter wavlengths. There is a window in the cyan absorption at about 500 nm but this window does not exist for magenta toner and yellow toner absorbs strongly below 550 nm. BZP AMAT and a-Si, as well as other well known photosensitive charge generating pigments respond well at 500 nm.

Following is a discussion of prior art, incorporated herein by reference, which may bear on the patentability of the present invention. In addition to possibly having some relevance to the question of patentability, these references, together with the detailed description to follow, are intended to provide a better understanding and appreciation of the present invention.

U.S. Pat. No. 5,048,040 granted to Thomas L Paoli on Sep. 10, 1991 describes a multiple wavelength semiconductor laser with two active layers separated by either a p-cladding layer or a p-n junction cladding layers. A p-disordered region and a n-disordered region extend through one of the active layers and into the intermediate cladding layer. A lateral waveguide is formed between the disordered regions in the active layer and a deep waveguide is formed beneath the p-disordered region in the other active layer. Since both active layers generate lightwaves at different wavelengths, forward-biasing the p-disordered region can cause either or both waveguides to emit radiation but at different wavelengths. The deep waveguide can also be a buried heterostructure laser

BRIEF DESCRIPTION OF THE INVENTION

Image processing latitude is enhanced by the provision of a dual laser diode or LED exposure device which operates in a spectral region where cyan pigment has a low coefficient of extinction; i.e. where incident light is not stronlgly absorbed. Cyan pigments have a transmission window around 500 nm. Using a light source operating in the region of this window permits use of preferred photoreceptors such as BZP AMAT and a-Si which are responsive to light at the 500 nm wavelength as well as light emitted at a wavelength around 680 nm.

Thus, cyan toner need not be the last toner used in forming composite images. In prior art devices, it was necessary to lay down cyan images last because of its high absorption factor relative to the types of exposure devices normally employed.

DETAILED DESCRIPTION OF THE PREFERRED EMBODIMENT OF THE INVENTION

This invention relates to an imaging system which is used to produce an Image On Image (IOI) color output. The invention will be described in connection with image creation which is effected in a single revolution or pass of a photoreceptor belt past a plurality of xerographic processing stations. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass IOI color process system, and a single or multiple pass highlight or spot color system. Such alternative systems may use either drum or belt format photoreceptors. In a mutliple pass system the steps decribed below will still be followed but they will not require a multiplicity of stations; a single set of stations (except for development) can perform the same steps in a serial fashion on each pass of the photoreceptor by them. In particular, only one dual wavelength image exposure station would be required. The number of developer stations remains at four (4) and a means must be provided for bringing each color development station into the development position for each subsequent color.

Figure 3:
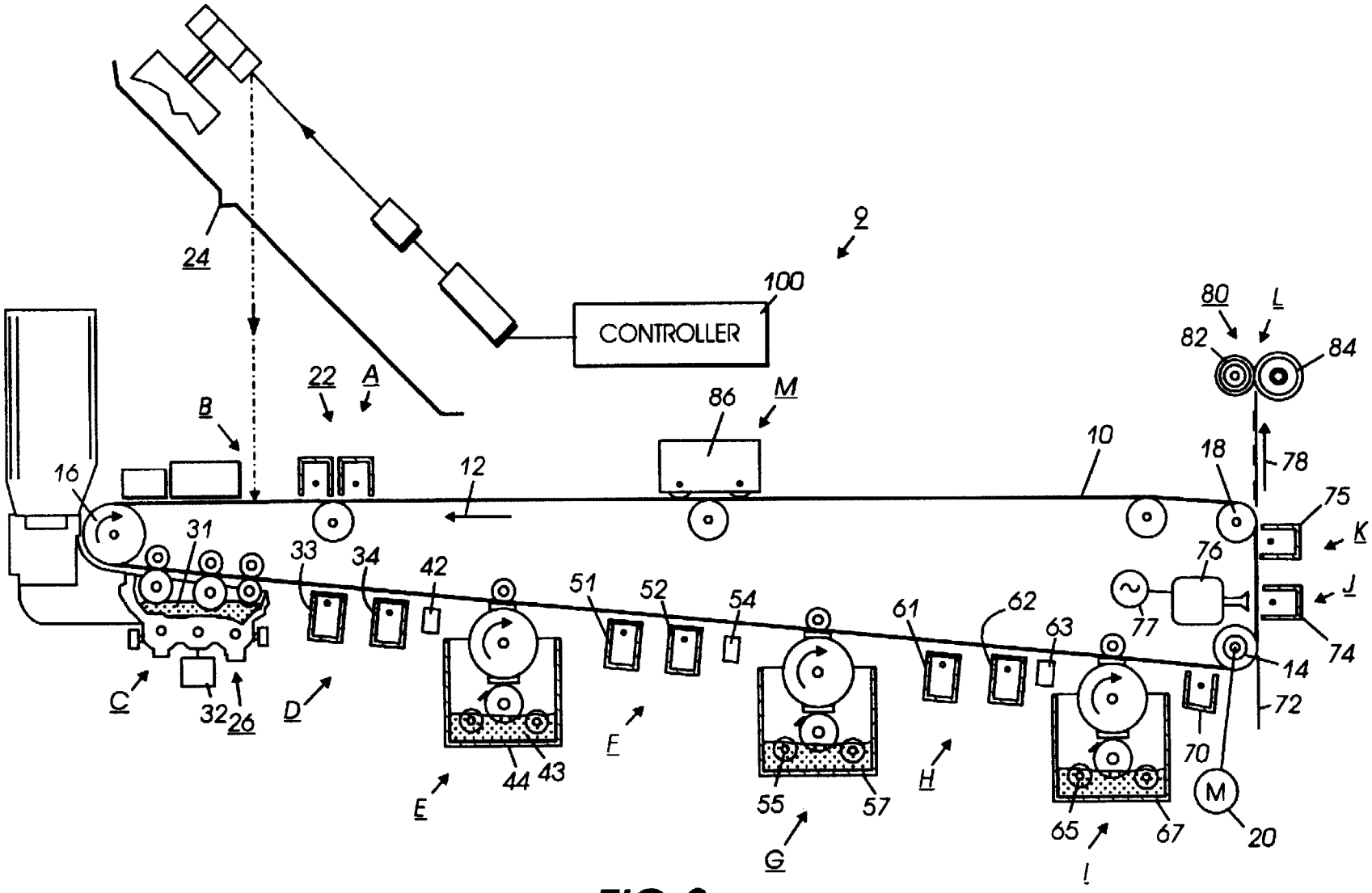
FIG. 3 is a schematic illustration of a single pass full process color printing apparatus incorporating the present invention.

Turning now to FIG. 3, the electrophotographic printing machine 9 of the present invention uses a charge retentive surface in the form of photoreceptor belt 10 supported for movement in the direction indicated by arrow 12, for advancing sequentially through the various xerographic process stations. Pursuant to the invention, the belt 10 comprises non-IR photoreceptor such as BZP AMAT. The reason for choosing BZP AMAT is its superb stability which is what is required to deliver superior color print quality for production systems, as well as for office color machines, as well as the reasons given above in the background to the invention..

The belt is entrained about a drive roller 14 and two tension rollers 16 and 18. The drive roller 14 is operatively connected to a drive motor 20 for effecting movement of the belt through the xerographic stations.

With continued reference to FIG. 3, a portion of belt 10 passes through charging station A where a corona generating arrangement, indicated generally by the reference numeral 22, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image on image color image formation process, as will be hereinafter described.

Next, the charged portion of photoconductive surface is advanced through an imaging or exposure station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices known in the art. Pursuant to the invention, the laser based output scanning device 24 comprises a dual wavelength device capable of emitting 500±10 nm, and 680±20 nm beams, which enable the use of BZP AMAT or a-Si or other photoreceptor with a wavelength response <780 nm. The 680 nm wavelength light is used to image through yellow and magenta, and 500 nm wavelength light through cyan. The 680 nm wavelength light is used to image through a combination of yellow and magenta toners while the 500 nm wavelength light is used to image through toner combinations of yellow and cyan, magenta and cyan and cyan magenta and yellow. By using the dual wavelength laser, the sequence of toner image formation is not critical. Thus, cyan toner images need not be the last to be created as is the case in prior art image creation machines. Either wavelength can be used in the absence of toner on the photoreceptor.

By way of example, a BZP AMAT photoreceptor, which is initially charged to a voltage $V_0$, undergoes dark decay to a level $V_{ddp}$ equal to about −500 volts. When exposed at the exposure station B the image areas are discharged to $V_{DAD}$ equal to about −50 volts. Thus after exposure, the photoreceptor contains a unipolar, negative voltage profile of high and low voltages, the former corresponding to charged areas and the latter corresponding to discharged areas. In the instant case, the discharged areas are the image areas while the charged areas represent the background voltage. It will be appreciated, that the charged areas may be used as the image areas in which case the discharged areas would represent the background.

At a first development station C, a magnetic brush developer housing structure, indicated generally by the reference numeral 26 advances Insulative Magnetic Brush (IMB) material or powder particles in the form of toner particles 31 into contact with the DAD image areas. The development structure 26 comprises a plurality of magnetic brush roller members. These magnetic brush rollers present, for example, negatively charged cyan toner material to the charged image areas for development thereof. Appropriate developer biasing is accomplished via power supply 32. Electrical biasing is such as to effect Discharged Area Development (DAD) of the less negative of the two voltage levels on the photoreceptor with the material 31.

At recharging station D, a pair of corona recharge devices 33 and 34 are employed for adjusting the voltage level of both the toned and untoned areas on the photoreceptor surface to a substantially uniform level. A power supply coupled to each of the electrodes of scorotron recharge devices 33 and 34 and to any voltage control element such as the scorotron grid associated therewith, serves as a voltage source to the devices. The recharging devices 33 and 34 serve to substantially eliminate any voltage difference between toned areas and bare untoned areas, as well as to reduce the level of residual charge remaining on the previously toned areas, so that subsequent development of different color toner images is effected across a uniform development field. The first corona recharge device 33 overcharges the photoreceptor surface 10 containing previously toned and untoned areas, to a level higher than the voltage level $V_{ddp}$, for example, to −700 volts. The predominant corona charge delivered from corona recharge device 33 is negative. The second corona recharge device 34 reduces the photoreceptor surface 10 voltage to a desired final voltage, $V_f$, −500 volts. Hence, the predominant corona charge delivered from the second corona recharge device 34 is positive. Thus, a voltage split of 200 volts is applied to the photoreceptor surface. The voltage split ($V_{split}$) is defined as the difference in photoreceptor surface potential after being recharged by the first corona recharge device and the second corona recharge device, e.g. $V_{split}$=−700 volts—500 volts= −200 volts. The potential of surface 10 after passing the two corona recharge devices 33,34, as well as the amount of voltage split of the photoreceptor, are preselected to otherwise prevent the electrical charge associated with the developed image from substantially reversing in polarity, so that the occurrence of Under Color Splatter (UCS) is minimized. Further, the corona recharge device types and the voltage split are selected to ensure that the charge at the top of the toner layer is substantially neutralized rather than driven to the reverse polarity (e.g. from negative to become substantially positive).

A second exposure or imaging device 42 which may comprise a dual beam laser structure is utilized for selectively discharging the photoreceptor on toned areas and/or bare areas to approximately −50 volts, pursuant to the image to be developed with the second color developer. The particular values of the wavelength selected depends upon which color toner was developed at development station C. After this point, the photoreceptor contains toned and untoned areas at relatively high voltage levels (e.g. −500 volts) and toned and untoned areas at relatively low voltage levels (e.g. −50 volts). These low voltage areas represent image areas which are to be developed using discharged area development. To this end, a negatively charged developer material 43 comprising, for example, yellow color toner is employed. The toner is contained in a developer housing structure 44 disposed at a second developer station E and is presented to the latent images on the photoreceptor by a non-interactive, scavengeless developer system. A power supply (not shown) serves to electrically bias the developer structure to a level effective to develop the DAD image areas with the negatively charged yellow toner particles 43. At this point, the photoreceptor may contain image areas as well as nonimage areas. The image areas may contain yellow and cyan toner images as well as images containing a combination of cyan and yellow toner.

At a second recharging station F, a pair of corona recharge devices 51 and 52 are employed for adjusting the voltage level of both the toned and untoned areas on the photoreceptor to a substantially uniform level. A power supply coupled to each of the electrodes of corona recharge devices 51 and 52 and to any grid or other voltage control surface associated therewith, serves as a voltage source to the devices. The recharging devices 51 and 52 function in the same manner and for the same purpose as the corona devices 33 and 34.

A third latent image is created using an imaging or exposure member 54. In this instance, a third DAD image is formed, discharging to approximately −50 volts those bare areas and toned areas of the photoreceptor that will be developed with the third color image. This image is developed using a third color toner 55 contained in a non-interactive developer housing 57 disposed at a third developer station G. An example of a suitable third color toner is magenta. Suitable electrical biasing of the housing 57 is provided by a power supply, not shown. At this point, the photoreceptor may contain image and nonimage areas. The image areas may contain yellow, cyan and magenta images as well as images containing any combination of the three toners used.

At a third recharging station H, a pair of corona recharge devices 61 and 62 are employed for adjusting the voltage level of both the toned and untoned areas on the photoreceptor to a substantially uniform level. A power supply coupled to each of the electrodes of corona recharge devices 61 and 62 and to any grid or other voltage control surface associated therewith, serves as a voltage source to the devices. The recharging devices 61 and 62 are identical in function and purpose to the previously discussed recharging combinations 33,34 and 51,52.

A fourth latent image is created using a dual wavelength imaging or exposure member 63. A fourth DAD image is formed on both bare areas and previously toned areas of the photoreceptor that are to be developed with the black toner. This image is developed, for example, using a black color toner 65 contained in developer housing 67 at a fourth developer station I. Suitable electrical biasing of the housing 67 is provided by a power supply, not shown.

The developer housing structures 44, 57, and 67 are preferably of the type known in the art which do not interact, or are only marginally interactive with previously developed images. A non-interactive, scavengeless development device having minimal interactive effects between previously deposited toner and subsequently presented toner is described in U.S. Pat. No. 5,504,563 granted Apr. 2, 1996 to Dan A. Hays the relevant portions of which are hereby incorporated by referenced herein.

In order to condition the toner for effective transfer to a final substrate, a negative pre-transfer corona device 70 delivers negative corona to ensure that all toner particles are of the required negative polarity to ensure proper subsequent transfer.

Subsequent to image development a sheet of support material 72 is moved into contact with the toner images at transfer station J. The sheet of support material is advanced to transfer station J by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer corona device 74 which sprays positive ions onto the backside of sheet 72. This attracts the negatively charged toner powder images from the belt 10 to sheet 72. A detack corona device 75 is provided for facilitating stripping of the sheets from the belt 10.

Also, at the transfer station J there is provided a relativity high frequency acoustic or ultrasonic resonator 76, driven by an AC power source 77, which is arranged in vibratory relationship with the backside of the belt 10 at a position corresponding to the location of the transfer corotron device 74. The resonator provides mechanical means for assisting with the transfer of toner to the copy sheet or substrate 72. A detack corona device 75 is provided at detack station K for facilitating stripping of the substrate 72 from the photoreceptor belt 10.

After transfer, the sheet continues to move, in the direction of arrow 78, onto a conveyor (not shown) which advances the sheet to fusing station L. Fusing station L includes a fuser assembly, indicated generally by the reference numeral 80, which permanently affixes the transferred powder image to sheet 72. Preferably, fuser assembly 80 comprises a heated fuser roller 82 and a backup or pressure roller 84. Sheet 72 passes between fuser roller 82 and backup roller 84 with the toner powder image contacting fuser roller 82. In this manner, the toner powder images are permanently affixed to sheet 72 after it is allowed to cool. After fusing, a chute, not shown, guides the advancing sheets 72 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station M using a cleaning brush structure contained in a housing 86.

The various machine functions described hereinabove are generally managed and regulated by a controller 100, preferably in the form of a programmable microprocessor. The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

The recharge devices 33, 34, 51, 52, 61 and 62 have been described generally as corona generating devices, with reference to FIG. 3. However, it is understood that the corona generating devices for use in the present invention could be in the form of, for example, a corotron, scorotron, dicorotron, pin scorotron, or other corona charging devices known in the art. In the present example having a negatively charged photoreceptor, the negatively charged toner is recharged by a first corona recharge device of which the predominant corona charge delivered is negative. Thus, either a negative DC corona generating device, or an AC corona generating device biased to deliver negative current would be appropriate for such purpose. The second corona recharge device is required to deliver a predominantly positive charge to accomplish the objectives of the present invention, and therefore a positive DC or an AC corona generating device would be appropriate.

In operation of the machine 9, one of the other dual beams of 500 and 680 nm is employed depending upon the presence or absence of toner in the photoreceptor area to be imaged. When imaging takes place in a nonimaged area of the photoreceptor either beam can be used. When imaging takes place in a area of the photoreceptor already containing a toner image containing one or more toners one or the other of the two beams is used. The beam used is determined based on its capability to transmit enough light to discharge the photoreceptor through the toner or toners forming an already created toner image. It is desirable that the particular beam used have a coefficient of exstinction value not greater than 0.2 (see FIGS. 2 and 3). At this value approximately 65% of the light impinging on the toner is transmitted. If the value on the Y-axis is A, then the transmission is expressed as a percentage of the incoming light is $$T=[100/10^{A})]\%$$

For example, if A=0.1, then about 79% of the light is transmitted: if A=1.0, then only 10% of the light is transmitted and if A=1.5, then about 3% of the light is transmitted. In carrying out the invention it may be necessary to slightly extend or shift the transmission window for a particular toner due to variances related to the particular color pigments employed.

Figure 1:
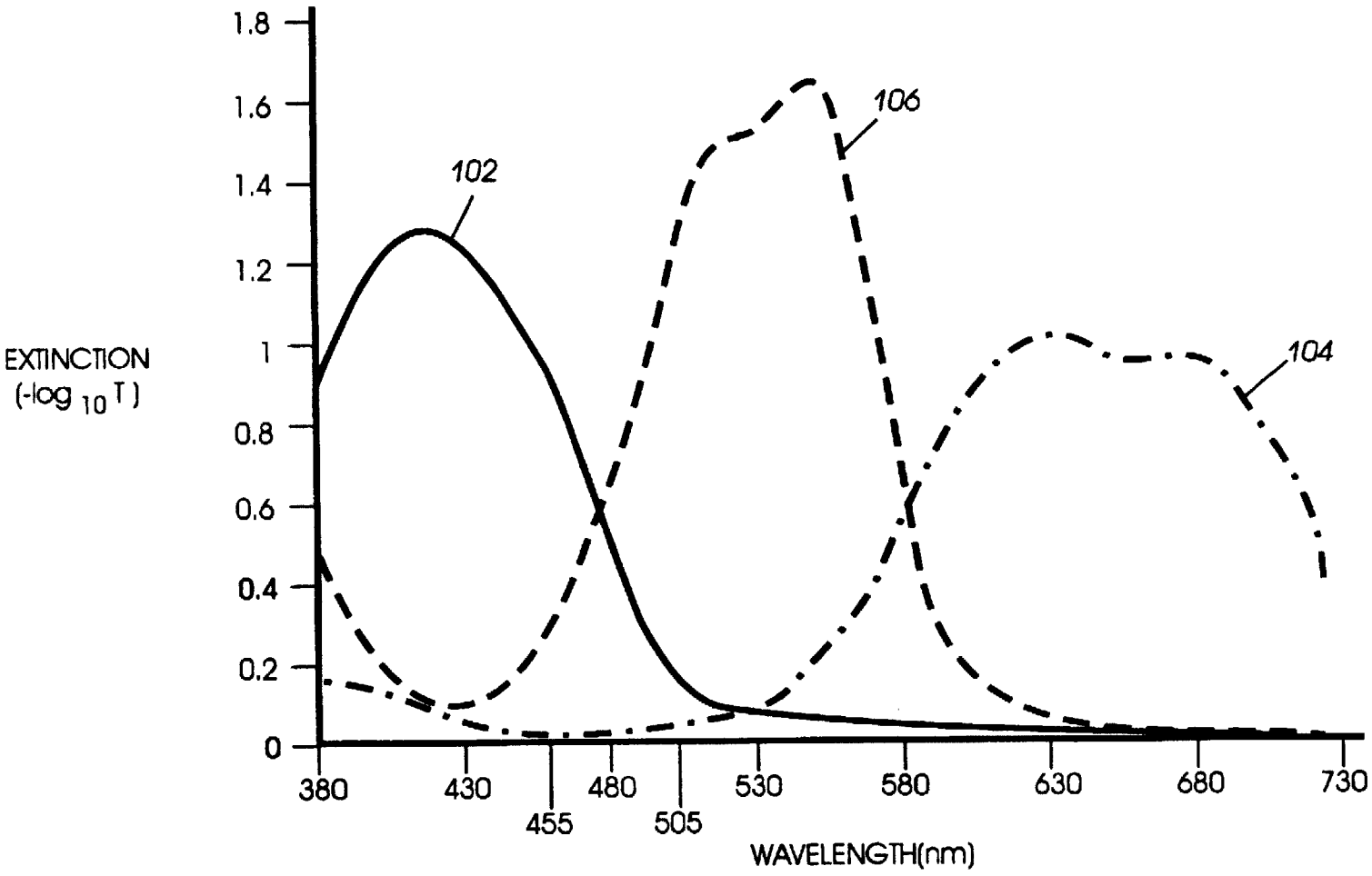
FIG. 1 is a plot of the transmission of light as function of wavelength through typical toner layers containing one of the pure CMY pigments.
Figure 2:
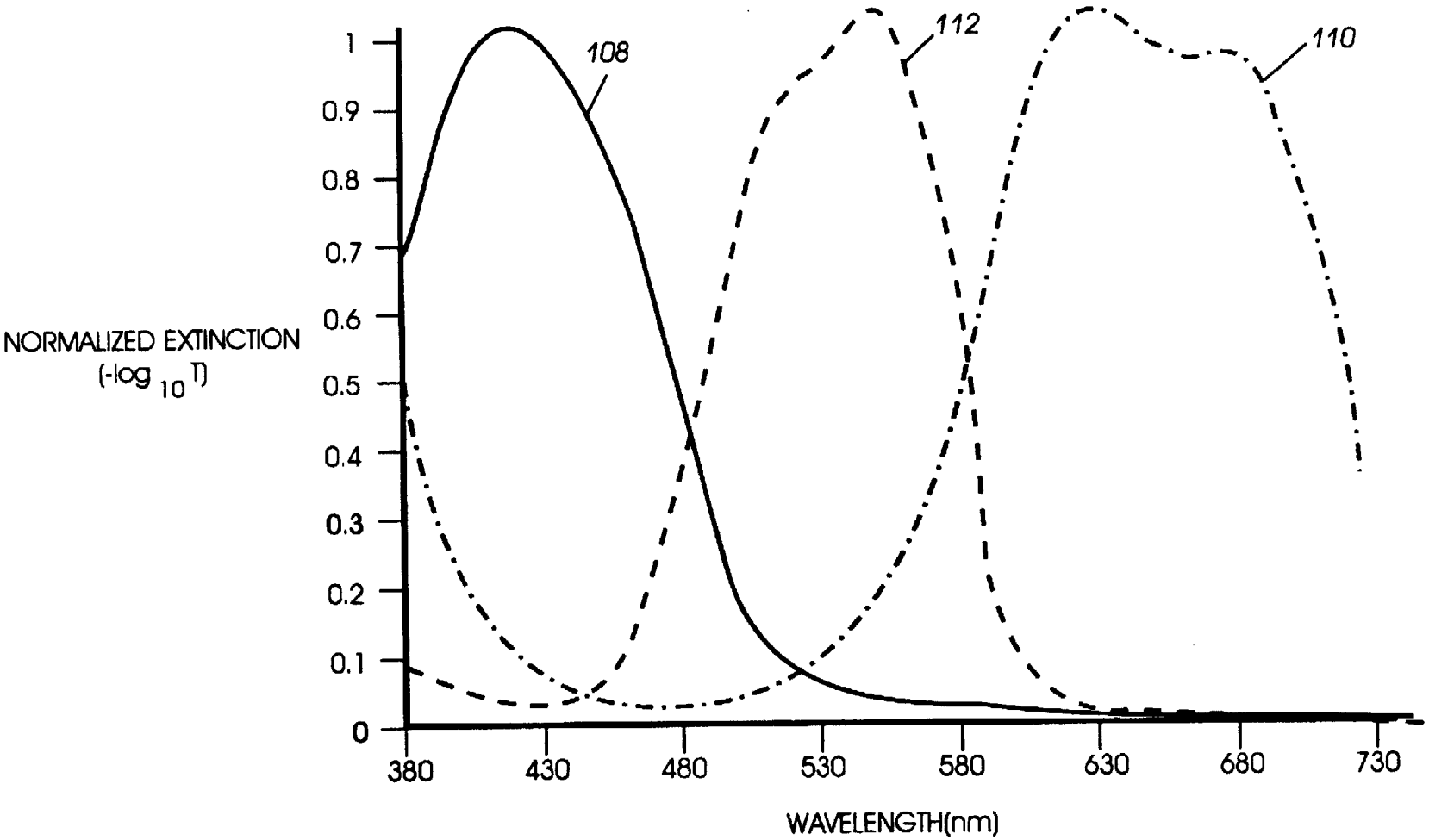
FIG. 2 is a plot of normalized absorptance of typical CMY pigments.

Illustrated in FIG. 1 are light transmission value for typical toner layers containing one of cyan, magenta and yellow colorant pigments. These light transmission values are depicted by plots of the coefficient of extinction versus wavelength for toners containing yellow pigment represented by reference character 102, cyan pigment represented by reference character 104 and magenta pigment represented by reference character 106. Illustrated in FIG. 2 are normalized absorptance values for typical cyan, magenta and yellow pigments depicted. The absorptance values are depicted by plots of the coefficient of extinction divided by $T_{max}$ versus wavelength for toners containing yellow pigment represented by reference character 108, cyan pigment represented by reference character 110 and magenta pigment represented by reference character 112. From a consideration of the plots shown in FIGS. 1 and 2, it can be observed that the transmission of light through yellow toner alone for a coefficient of extinction value of 0.2 occurs at a wavelength greater than 510 nm. Thus, the controller 100 is programmed to use the 680±20 nm beam when imaging through yellow toner alone. For imaging through magenta toner alone, a wavelength greater than 590 nm yields acceptable light transmission. Accordingly, the controller 100 is programmed to use the 680±20 nm beam for discharging the photoreceptor through magenta pigmented toner alone. For imaging through cyan pigmented toner alone, light at a wavelength greater than 410 nm and less than 530 nm is acceptable. Accordingly, the controller 100 is programmed to use the 500±10 nm beam for imaging through cyan pigmented toner alone.

For imaging through a combination of yellow and magenta pigmented toners, a wavelength greater than 590 nm is found to be acceptable, therefore, the 680±20 nm is used. In like manner, it can be observed from FIGS. 1 and 2 that when imaging through a combination of yellow and cyan pigmented toners a wavelength in the range of 490 to 540 nm yields adequate light transmission. Thus, for this case, the 500±10 nm beam is employed. The 500±10 nm beam is also used for imaging through a combination of pigmented magenta and cyan toner as well as through a combination of yellow, magenta and cyan pigmented toners. For a spot color printer, the exposure system wavelengths will need to be adjusted to match the transmission windows of the particular color pigments selected.

I claim:

1. In a method of creating color images on a charge retentive structure using IOI development, the steps including:

providing a charge retentive structure responsive to two wavelengths of light;

using beams of a dual wavelength exposure device for forming a plurality of latent electrostatic images on said charge retentive surface, said beams being of different wavelengths; one of said beams having a wavelength capable of transmission through cyan toner and another of said beams having a wavelength capable of transmission through magenta and yellow toner;

developing said plurality of latent electrostatic images with various colors of toner, at least one of which contains cyan pigment;

using said beam having a wavelength capable of transmission through cyan toner, forming other latent electrostatic images in areas of said charge retentive structure with toner containing cyan pigment; and developing some of said other latent electrostatic images with toner containing magenta pigment and developing some of said other latent electrostatic images with toner containing yellow pigment.

2. The method according to claim 1 wherein said step of providing a charge retentive surface comprises providing a photoconductive member.

3. The method according to claim 2 wherein said step of providing a charge retentive surface comprises providing a BZP AMAT photoconductive member.

4. The method according to claim 3 wherein said step of providing a charge retentive surface comprises providing an amorphous silicon photoconductive member.

5. The method according to claim 4 wherein said step of using beams of a dual wavelength exposure device comprises using a laser diode.

* * * * *